United States Patent [19]

Meadows

[11] 4,375,833

[45] Mar. 8, 1983

[54] AUTOMATIC WELL TREATMENT SYSTEM

[76] Inventor: Floyd G. Meadows, Rte 2, Box 199, Mena, Ark. 71953

[21] Appl. No.: 299,329

[22] Filed: Sep. 4, 1981

[51] Int. Cl.[3] ..... E21B 43/12

[52] U.S. Cl. ..... 166/64; 166/53; 137/624.2

[58] Field of Search ..... 166/64–66, 166/53, 312; 137/624.2

[56] References Cited

U.S. PATENT DOCUMENTS

| | | | |
|---|---|---|---|
| 3,223,167 | 12/1965 | Hampton | 166/75 |
| 3,242,990 | 3/1966 | Keaton, Jr. | 166/54 |
| 3,710,867 | 1/1971 | Bansbach | 166/244 C |
| 4,064,936 | 12/1977 | McClure | 166/75 R |
| 4,132,268 | 1/1979 | Harrison | 166/64 X |
| 4,211,279 | 7/1980 | Isaacks | 166/64 |
| 4,235,849 | 11/1980 | Handeland | 422/263 |
| 4,352,376 | 10/1982 | Norwood | 166/64 X |

*Primary Examiner*—Ernest R. Purser
*Assistant Examiner*—Thuy M. Bui
*Attorney, Agent, or Firm*—Hubbard, Thurman, Turner & Tucker

[57] ABSTRACT

A system for chemical treatment of producing oil wells has automatically actuated valves operated by a control circuit. The control circuit causes the system to automatically switch the well from production to treatment status without shutting down. After a predetermined treatment period, wherein well fluids mixed with treatment chemical are recirculated throughout the well, the control circuit causes the system to change state and switch to production status. One embodiment of a means for pumping the treatment chemical into the well includes a continuous pump actuated by the mechanism of the well pump, and which includes two electrically actuated valves. The control circuit automatically operates the valves to cause treatment chemical to be injected into the well when desired, then changes the position of the valves so that the chemical which is continuously being pumped will return to the storage tank in a continuous stream.

8 Claims, 4 Drawing Figures

AUTOMATIC WELL TREATMENT SYSTEM

BACKGROUND OF THE INVENTION

This invention relates generally to chemical treatment of producing oil wells and more specifically to a system for automatically treating such wells without human intervention.

Producing oil wells contain a variety of corrosives. These corrosives are mixed with the well fluids, such as petroleum and water, and cause damage to the various parts of the well, especially the down hole pump and production tubing. These corrosives can be counteracted by introducing liquid treatment chemicals into the well. Use of such chemicals prevents corrosion of the various parts of the well, and greatly extends its life. The treatment chemical is easily separated from the desired petroleum along with water and other well fluids.

Several methods are presently in use to chemically treat producing oil wells. One very common method is to introduce a continuous stream of treatment chemical into the well during production. This is usually accomplished through the use of a small treatment chemical pump connected to the mechanism of the larger well pump. This pump is located above ground, and constantly introduces a small amount of chemical into the well on a continuous basis while the well pump is in operation. This treatment chemical falls to the bottom of the well, where it mixes with the other well fluids. The chemical counteracts corrosives at the bottom of the well, and in the production tubing as it is pumped to the surface along with the remaining well fluids. The chemical is easily separated from the petroleum after production, although it is not reusable.

Another common method of well treatment involves introducing a measured portion of treatment chemical into the well, and recirculating the well fluids containing such chemical throughout the well for a period of time. A typical means of accomplishing this type of treatment is to have a truck containing the treatment chemical drive to each well site. When the truck reaches the well site, the well is shut down, and a hose is coupled from the truck to piping leading into the well casing. Two or more valves are operated, so that well fluids brought to the surface through the production tubing are recirculated back into the well casing. A predetermined amount of chemical is then pumped into the well casing, and the well pump restarted. The well fluids mix thoroughly with the treatment chemical, and this mixture is circulated throughout the well for a predetermined period of time. The well is then stopped, and the valves are reset in their original state. The well pump is then restarted, and resumes production. The treatment operator then moves on to the next site.

A variation of this recirculation method involves storage of chemical on site instead of being brought in by truck for each treatment. An operator shuts down the well, and introduces chemical from the on site holding tank instead of from the truck. Otherwise, this method is the same as just outlined.

Present methods of chemically treating producing oil wells have a number of drawbacks. The continuous method of treating a well is wasteful of the treatment chemical. The chemical which is introduced into the well makes only a single pass through the well piping, and is then discarded with the production fluids. This single pass through the well does not allow the treatment chemical to be fully utilized. Therefore, excess chemical must be introduced so that the well will be properly treated at this low efficiency.

The recirculation method has advantages in that it can more fully utilize the non-corrosive properties of the treatment chemical, but has a number of important drawbacks of its own. The requirement of a human operator, whether he transports treatment chemical with him or merely utilizes that stored on site, means that treatment of the well is very often on an erratic basis and off schedule. When a well is treated with the recirculation method, it is important that it is treated for a predetermined period of time at a predetermined frequency. Poor weather conditions, as well as sickness and so forth, often prevent a human operator from treating the well at the proper time, and several treatment periods may be missed entirely. This can cause damage to the well, and repeated instances of missing treatment periods or mistiming them may eventually necessitate a shut-down for repairs.

Additionally, the conditions at each well usually differ somewhat from those of other wells, calling for treatment times of various lengths and various frequencies. In addition to the possibility of mistake on the part of the human operator, whereby treatment times and frequencies for various wells are accidentally interchanged, the varying period between treatments for each well means that eventually the human operator must treat some wells at a time which approximates the planned treatment time. On a fairly frequent basis, the treatment schedule requires that the operator treat wells at one time, which of course he cannot do. Therefore, a certain amount of juggling in treatment schedules is required. This situation is worsened when bad weather or other nonproduction related influences interfere.

A certain amount of production time is lost when the operator sets up the recirculation state for the well. The well pump must be shutdown and restarted twice, and the valves must be operated. This time loss is not extreme, but can become significant on wells which must be treated often. In addition to the cost of lost production time, the high cost of semi-skilled labor adds to the overall cost of using present recirculation treatment methods.

SUMMARY OF THE INVENTION

It is therefore an object of the present invention to provide a method and apparatus for chemically treating producing oil wells at the desired time.

It is another object of the present invention that such a method utilizes recirculation of the treatment chemical to make full use of such chemical.

It is another object of the present invention that such treatment be automatic at each well site, so that no human operator is needed at any time once the system has been installed.

Therefore, according to the present invention, an automated well treatment system includes production and recirculation valves automatically operated by an electronic control circuit. Such valves are actuated by electric motor drivers, which are controlled by relays contained within the control circuit. The valves are normally in the production state, and when a timing mechanism in the control circuit determines that the period for well treatment has arrived, the valves change state so that the well fluids are recirculated back into the well casing. This change from production to recirculation status is accomplished without shutting down operation of the well. A predetermined amount of treatment chemical is introduced into the well, and recirculated throughout the well along with the well fluids. The well is treated for a predetermined period of time as controlled by the control circuit. When the treatment period is over, the valves are again caused to change position by the control circuit, and the well resumes production. This is again accomplished without shutting down the well.

An alternative embodiment of the present invention makes use of the continuous treatment pump presently in place on many producing wells. Return piping is coupled to the line between the pump and the well casing so that treatment chemical is returned to the holding tank when it is not being pumped into the well. Treatment and return valves operate in a manner similar to the production and recirculate valves discussed above, so that treatment chemical is either being pumped into the well or constantly recirculated from the pump to the holding tank. This embodiment may be combined with the recirculation well treatment system to provide a fully automated recirculation system which utilizes on site continuous operation chemical pumps, or may be used separately as an interrupted version of the continuous treatment method.

The novel features which characterize the present invention are defined by the appended claims. The foregoing and other objects and advantages of the invention will hereinafter appear, and for purposes of illustration, but not of limitation, a preferred embodiment is shown in the accompanying drawings.

DETAILED DESCRIPTION OF THE PREFERRED EMBODIMENTS

Figure 1:
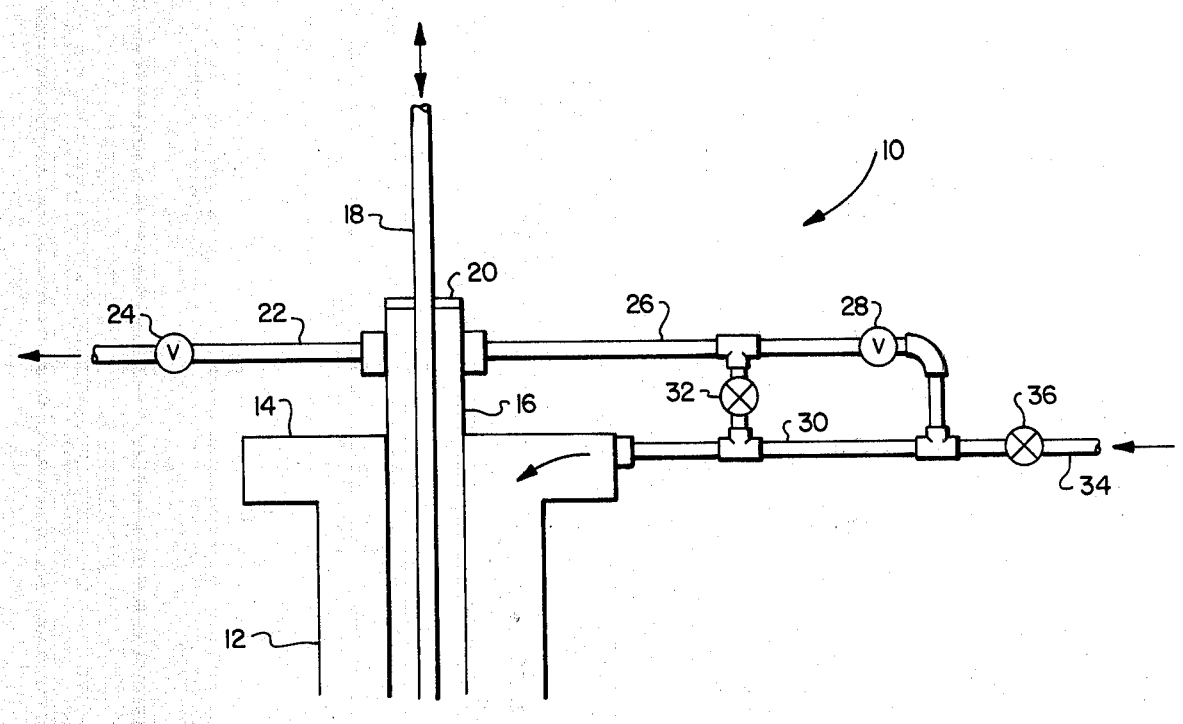
FIG. 1 is a schematic diagram of a well circulation system according to a preferred embodiment of the present invention.

FIG. 1 is a diagram of a well treatment assembly 10 according to a preferred embodiment of the present invention. A well casing 12 is sunk into the ground in a conventional manner. A well head assembly 14 supports a production tubing string 16 which extends through the well head 14. A pump rod 18 is disposed within the tubing 16 and projects above the tubing 16 through a stuffing box 20. Production piping 22 is coupled to the annular space between the tubing 16 and the pump rod 18, so that oil may flow from the tubing 16 through the production piping 22. A ball valve 24 is located in the production piping 22 and is actuated by an electric motor (not shown) which opens and closes the valve 24 according to an electric signal.

Recirculation piping 26 is coupled to the tubing 16, and also contains a motor actuated ball valve 28. Casing intake piping 30 is coupled to the casing 12 and to the recirculation piping 26 so that production fluid will recirculate from the tubing 16 through the piping 26 and 30, and back into the casing 12 to fall to the bottom of the well, when the recirculation valve 28 is open. As discussed in connection with FIG. 2, the production and recirculate valves 24 and 28 are operated so that one is always open, and they are not open at the same time. In case a malfunction of the system should cause both the production and recirculate 24, 28 valves to be closed at the same time, extreme pressures will be built up in the tubing 16 and piping 22, 26 as the production fluid will have nowhere to escape. Therefore, a pressure relief valve 32 is coupled between the recirculate piping 26 and the casing input piping 30. High pressures in the tubing 16 will cause the pressure relief valve 32 to open, and production fluid to recirculate back into the casing 12. This prevents damage from extreme pressure to the tubing 16, stuffing box 20 and other parts of the system.

Treatment chemical inlet piping 34 is coupled to the junction of the recirculate piping and the intake piping. A check valve 36, or one way valve, prevents the flow of fluid from left to right as seen in FIG. 1. As will be discussed in more detail below, treatment chemical is periodically pumped into this system, and flows through the check valve 36 from right to left and into the well casing 12.

Figure 2:
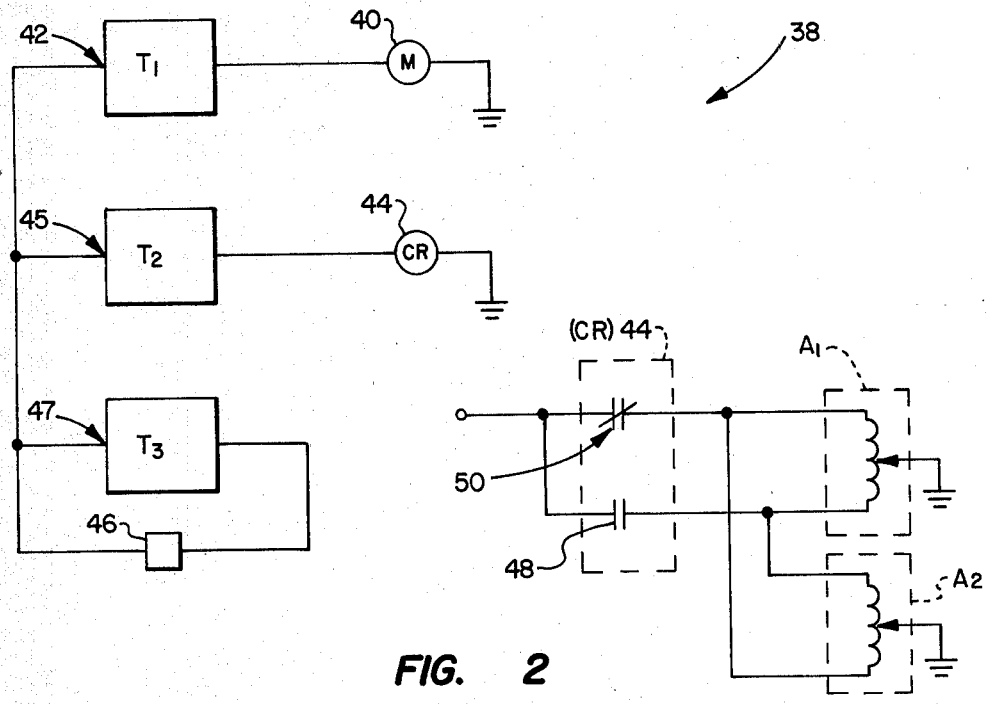
FIG. 2 is a schematic diagram of a preferred control system for the well treatment system of the present invention.

A preferred control system 38 for operation of the present system is shown in FIG. 2. Timer $T_1$ is an electronic timer which is either on or off, and which drives a pump motor 40 while in the on state. Timer $T_1$ remains in the off state until receipt of a trigger signal at the trigger input 42, at which time timer $T_1$ switches to the on state and remains on for a predetermined period of time. After this predetermined delay, timer $T_1$ again returns to the off state. The length of the time delay is controllable, and is set in advance in accordance with the particular characteristics of the well, as discussed below.

Timer $T_2$ operates in a similar manner, and drives a control relay 44 while in the on state. Timer $T_2$ has a trigger input 45, and preferably has an on time delay greater than does timer $T_1$, as explained in more detail in connection with FIG. 3.

Timer $T_3$ operates in the same manner as timers $T_1$ and $T_2$, with the output of timer $T_3$ being coupled to a fixed delay circuit 46. $T_3$ has a trigger input 47 similar to those of $T_1$ and $T_2$. When timer $T_3$ turns off, a trigger signal is output from the delay circuit 46 after a short period of time. This trigger signal triggers all three timers $T_1$, $T_2$ and $T_3$ into the on state at the same time, as discussed more fully in connection with FIG. 3.

The control relay 44 is a double-throw relay, having one normally open contact 48 and one normally closed contact 50. The electric actuator motors for the production and recirculation valves 24 and 28, represented schematically by armatures $A_1$ and $A_2$, are each connected to both relay contacts 48, 50. With the control relay 44, and thus both relay contacts 48 and 50, in a given state, the motor actuators for both valves 24, 28 are driven fully to either the open or closed position. In FIG. 2, the actuator represented by armature $A_1$ drives the production valve 24, and the actuator represented by armature $A_2$ drives the recirculate valve 28. With the actuators connected as in FIG. 2, with the relay 44 in its normal (non-activated) position, current will flow down through armature $A_1$ and to ground. Current will simultaneously flow up through armature $A_2$ and to ground, indicating that the valves 24,28 are driven in opposite directions. When the control relay 44 changes state, so do both contacts 48, 50, and current will flow up through armature $A_1$ and down through armature $A_2$. This causes both electric actuators to be driven in the opposite direction, thus changing the positions of the production and recirculate valves 24 and 28. As shown in FIG. 2, current flowing down through an armature and to ground represents a valve driven to the open position, while current entering the armature from the botton and flowing to the ground drives the valve to a closed position. Safety switches (not shown) contained in the valve actuator mechanism open the armature circuit when the valve has been driven to the fully open or fully closed position.

Figure 3:
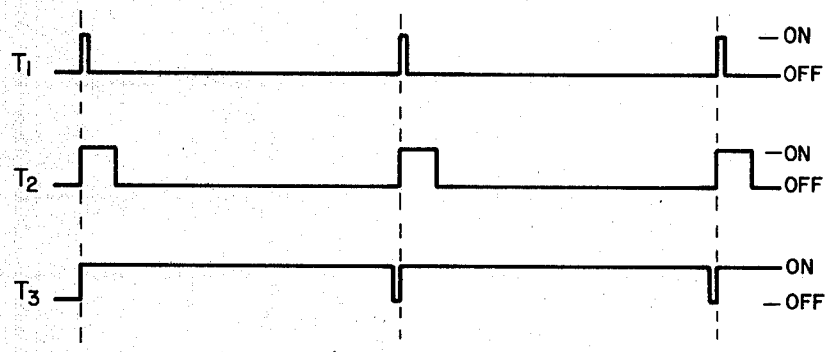
FIG. 3 is a timing diagram for the control system of FIG. 2.

According to FIG. 3, a timing diagram showing the states of the timers $T_1$, $T_2$ and $T_3$ is shown. Timer $T_1$ has a very short delay, and is thus only on for a short period of time in each cycle. Timer $T_2$ has a somewhat longer delay period, while $T_3$ has a delay period which is longer than that of timer $T_2$. These delay periods correspond to various portions of the well treatment cycle, and thus will be different for each particular well. When $T_1$ is on, the chemical treatment pump motor 40 is on and pumping treatment chemical into the well casing 12. While timer $T_2$ is on, the recirculate valve 28 is open and the production valve 24 is closed. This causes the production fluid to be recirculated from the tubing 16 back into the well casing 12. This is done while the treatment chemical is in the well, causing the treatment chemical to be constantly recirculated throughout the well. When timer $T_1$ turns off, the production valve 22 opens and the recirculate valve 28 closes. This causes the well to begin production again, and the treatment chemical is quickly pumped out of the well and is no longer effective. When timer $T_3$ turns off, there is a short time delay caused by the delay circuit 46, then a trigger signal resets all three timers simultaneously.

This cycle is repeated on a basis which is determined for each well. The time delays associated with each timer may be, for example, one minute for $T_1$, one hour for $T_2$ and three days for $T_3$. Thus, every three days treatment chemical would be pumped into the well for one minute, and the recirculation treatment of the well would last for one hour. The time delays are selected to match the properties of each well. A well needing more treatment could require more chemical, or longer or more frequent treatment periods. Wells needing less treatment could require less chemical, or shorter or less frequent treatment periods.

It is important to note, and is a prime benefit of this invention, that the well need not be shut down at any time. Through automatic control of the production and recirculate valves 24 and 28, the control system 38 switches from the production to recirculate state without otherwise interrupting well operation. There is no necessity for a human presence in order to chemically treat the well. Also, nonproduction time at the well is kept to a minimum because no time is lost in shutting down the well and manually changing the positions of valves.

Figure 4:
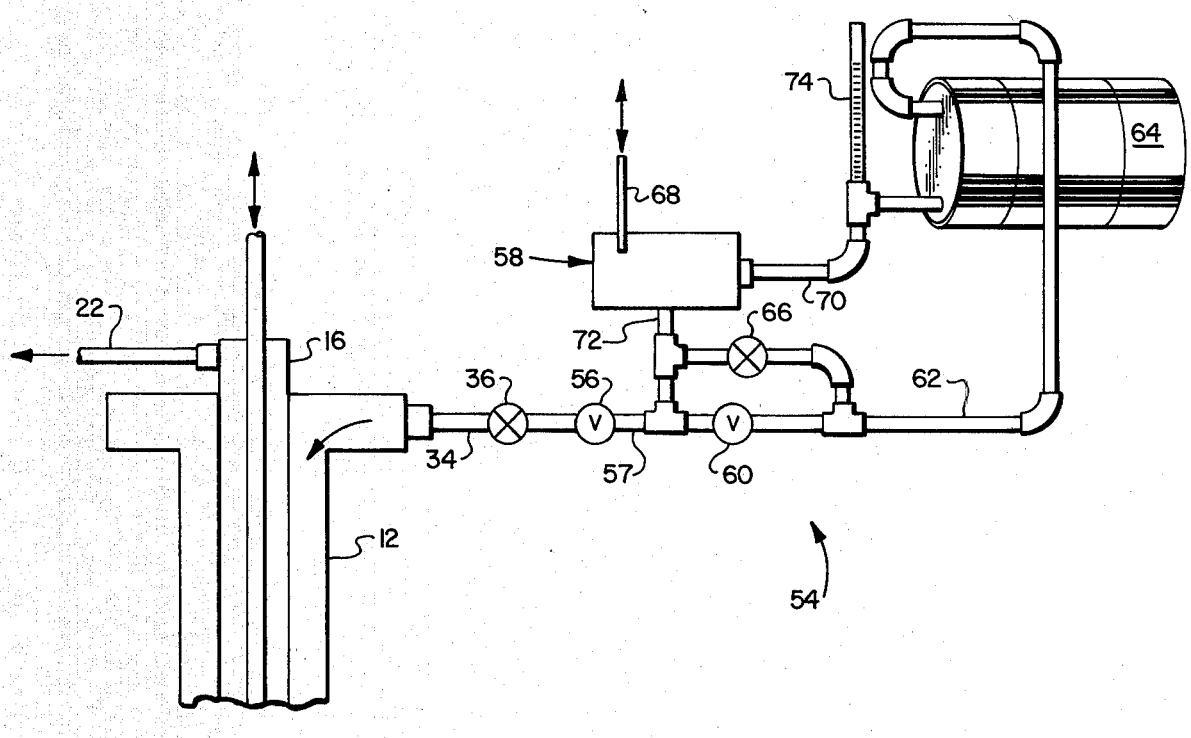
FIG. 4 is a diagram showing an alternative chemical pump.

As described above, the treatment chemical is introduced into the well by a small electric pump 40 controlled by timer $T_1$. FIG. 4 shows an alternate pumping arrangement 54 for the treatment chemical which may be used with the recirculation system 10 of FIG. 1, or independently of such system.

When used independently, the improved pumping system 54 operates as an "interrupted-continuous" chemical treatment system. On most wells presently in production, the treatment chemical is constantly introduced into the well casing at a slow rate. Even at slow rates, however, more treatment chemical than is actually needed is usually introduced into the well. To prevent this waste of treatment chemical, the system of FIG. 4 can be used. This system provides a treatment method very similar to previous continuous treatment methods, with the difference being that the chemical is only introduced into the well part of the time. For example, the continuous treatment could run for one hour out of every three. This method is otherwise similar to the continuous method in that chemical which is introduced into the well makes only one pass through the well and is pumped through the production piping to the holding area.

Referring to FIG. 4, production piping 22 is coupled to the tubing 16, and channels production fluids to a storage area. Chemical input piping 34 is coupled to the casing 12 whereby chemical is introduced into the well. The check valve 36 prevents back pressure which may be in the well casing 12 from forcing treatment chemical backwards through the piping 34. A treatment valve 56 is located in the piping 57 between a pump 58 and the well casing 12, and a return valve 60 is located in return piping 62 between the pump 58 and a storage tank or barrel 64. Both valves 56, 60 are electric motor actuated ball valves of the type described in connection with FIG. 1. A pressure relief valve 66 is coupled in parallel with the return valve 60 so that treatment chemical will be automatically recirculated into the storage tank 64 in the event that ball valves 56, 60 should be simultaneously closed due to a system malfunction.

The pump 58 is a conventional chemical pump driven by a reciprocating rod 68 coupled to a walking beam (not shown) of the well pump mechanism. The treatment pump rod 68 reciprocates in step with the well pump rod 18, although with a shorter stroke. The reciprocation of the treatment pump rod 68 causes the pump 58 to draw treatment chemical from the holding tank 64 through intake piping 70 and discharge it through discharge piping 72. A calibrated tube 74 shows the amount of chemical remaining in the treatment tank 64.

The treatment and return valves 56, 60 operate similarly to the production and recirculate valves 24, 28 of FIG. 1, and are driven to the opposite state (open or closed) by the control circuit 38 of FIG. 2, with slight modifications. When the treatment valve 56 is open, the return valve 60 is closed and treatment chemical is pumped into the well. When the treatment period is over, the treatment valve 56 closes while the return valve 60 opens, and the treatment chemical is pumped back into the holding tank 64. The treatment pump 58 operates continuously as it is connected to the same mechanism which drives the well pump. Recirculating the treatment chemical back to the holding tank 64 causes the treatment system to, in effect, be placed on hold until the next time to treat the well arises.

The control system 38 of FIG. 2 is used to drive the system 54 of FIG. 4, except that timer $T_1$ is not connected. The control relay 44 driven by timer $T_2$ drives the actuators $A_1$, $A_2$ for the treatment and return valves 56, 60. The treatment valve 56 is open when timer $T_2$ is on, and closed when $T_2$ is off. The return valve 56 is in the opposite state, being open when $T_2$ is off and closed when $T_2$ is on. This opening and closing of valves is accomplished in the same manner as discussed with the system of FIGS. 1 and 2.

Since a continuous treatment pump similar to that shown in FIG. 4 is found on many producing wells, a significant cost savings can be realized by combining the treatment pump system 54 of FIG. 4 with the recirculate system 10 of FIG. 1. The operation of these systems separately has been discussed in detail, and it merely remains to discuss their simultaneous use.

With the recirculate system 10 of FIG. 1, treatment chemical is pumped into the well when timer $T_1$ is on. In the combined system, the pump motor 40 driven by $T_1$ in FIG. 2 is replaced with a second control relay (not shown), which is identical to the control relay 44 coupled to the output of $T_2$, and the second relay is connected to the electric actuators of the two ball valves 56 and 60 in a likewise identical manner. The treatment and return valves 56 and 60 operate in the same manner as discussed with FIG. 4, with the exception that they are controlled by the relay coupled to the output of timer $T_1$. When $T_1$ is on, the treatment valve 56 is open and the return valve 60 is closed, causing treatment chemical to be introduced into the well. When timer $T_1$ is off, the treatment valve 56 is closed and the return valve 60 is open, so that no treatment chemical is introduced into the well. Timer $T_2$ remains on for a longer period than $T_1$, as discussed above, so that treatment chemical is recirculated throughout the well. When timer $T_2$ turns off, the well resumes production. This entire process takes place without shutting down the well pump, and without the necessity of on site operators.

Although a preferred embodiment has been described in detail, it should be understood that various substitutions, alterations, and modifications may become apparent to those skilled in the art. These changes may be made without departing from the spirit and scope of the invention as defined by the appended claims.

What is claimed is:

1. A system for automatic chemical treatment of a producing oil well having tubing, a casing and production piping, said system comprising:

a first automatic valve coupled to the production piping;

recirculation piping coupled to the tubing and to the casing;

a second automatic valve coupled to said recirculation piping;

a pump;

treatment piping coupled to said recirculation piping and to said pump;

a first timer circuit coupled to said pump, wherein treatment chemical is pumped into the well casing only when said first timer is on, said first timer having a reset input which turns said first timer on for a first predetermined period when a reset signal is received;

a second timer circuit having a reset input which turns said second timer on for a second predetermined period when a reset signal is received;

connection means coupled to said second timer for controlling the positions of said first and second automatic valves in a manner determined by the state of said second timer;

a third timer circuit having a reset input which turns said third timer on for a third predetermined period when a reset signal is received; and delay means coupled to the reset inputs of said first, second and third timers for providing a reset signal to said timers when said third timer turns off.

2. The system of claim 1, wherein said pump comprises:

a continuously operating fluid pump having discharge piping;

a holding tank coupled to the input of said fluid pump;

a third automatic valve coupled to the discharge piping and to said recirculation piping;

a fourth automatic valve coupled to the discharge piping, wherein fluids pumped through the discharge piping flow through said third or fourth valves;

return piping coupled to said fourth valve, wherein fluids flowing from the discharge piping through said fourth valve return to said holding tank;

a first control relay coupled to the output of said first timer and to said third and fourth valves, wherein the positions of said third and fourth valves are controlled by the state of said first timer.

3. The system of claims 1 or 2, wherein said connection means comprises:

a second control relay coupled to the output of said second timer and to said first and second automatic valves, wherein the positions of said first and second valves are controlled by the state of said second control relay.

4. The system of claim 2, further comprising a pressure relief valve coupled to said return piping and the discharge piping in parallel with said fourth valve.

5. The system of claim 1, further comprising a pressure relief valve coupled to said recirculation piping in parallel with said second valve.

6. An apparatus for intermittantly treating a producing oil well, comprising:

a continuously operated fluid pump;

discharge piping coupled to the output of said pump and providing fluid communication with the interior of the well;

an automatic treatment valve coupled to said discharge piping, wherein fluid flows into the well only when said treatment valve is open;

a holding tank coupled to the intake of said pump;

return piping coupled to said holding tank, and to said discharge piping between said pump and said treatment valve;

a controllable return valve coupled to said return piping, wherein fluid flows through said return piping only when said return valve is open;

a first timer having a reset input which turns said first timer on for a first predetermined period when a reset signal is received;

connecting means coupled to an output of said first timer for controlling the positions of said treatment and return valves as a function of the state of said first timer;

a second timer having a reset input which turns said second timer on for a second predetermined period when a reset signal is received; and delay means coupled to the reset inputs of said first and second timers for providing a reset signal to said timers when said second timer turns off.

7. The apparatus of claim 6, further comprising a pressure relief valve coupled to said return piping in parallel with said return valve.

8. The apparatus of claim 6, wherein said connecting means comprises a double throw relay.

* * * * *